US008412079B2

(12) United States Patent
Kubota et al.

(10) Patent No.: US 8,412,079 B2
(45) Date of Patent: Apr. 2, 2013

(54) TONER CARTRIDGE, IMAGE FORMING APPARATUS AND IMAGE FORMING METHOD

(75) Inventors: Hiroshi Kubota, Osaka (JP); Takeshi Okuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 324 days.

(21) Appl. No.: 12/898,042

(22) Filed: Oct. 5, 2010

(65) Prior Publication Data

US 2011/0081170 A1 Apr. 7, 2011

(30) Foreign Application Priority Data

Oct. 6, 2009 (JP) ..... 2009-232892

(51) Int. Cl.
*G03G 15/08* (2006.01)

(52) U.S. Cl. ..... 399/263

(58) Field of Classification Search ..... 399/258, 399/260, 263, 262
See application file for complete search history.

(56) References Cited

U.S. PATENT DOCUMENTS

| | | | | |
|---|---|---|---|---|
| 4,896,969 | A * | 1/1990 | Dray | |
| 7,313,348 | B2 * | 12/2007 | Hart et al. | |
| 2008/0089718 | A1 | 4/2008 | Ishiguro et al. | |
| 2008/0260431 | A1 | 10/2008 | Saito | |
| 2009/0074468 | A1 * | 3/2009 | Iwata et al. | |
| 2009/0092419 | A1 * | 4/2009 | Iwata et al. | |
| 2010/0003056 | A1 * | 1/2010 | Ishiguro et al. | 399/262 |
| 2010/0172674 | A1 * | 7/2010 | Suzuki | 399/258 |
| 2010/0272476 | A1 * | 10/2010 | Shima et al. | 399/258 |
| 2011/0013945 | A1 * | 1/2011 | Hatakeyama et al. | |
| 2011/0020037 | A1 * | 1/2011 | Sakamoto et al. | |
| 2011/0222917 | A1 * | 9/2011 | Ichikawa | 399/263 |
| 2012/0189353 | A1 * | 7/2012 | Mihara et al. | 399/258 |

FOREIGN PATENT DOCUMENTS

| | | | |
|---|---|---|---|
| JP | 56144473 | A * | 11/1981 |
| JP | 05072952 | A * | 3/1993 |
| JP | 06-118792 | | 4/1994 |
| JP | 2004-334054 | | 11/2004 |
| JP | 2007-017464 | | 1/2007 |
| JP | 2008-96914 | | 4/2008 |
| JP | 2008-268445 | | 11/2008 |
| JP | 2009-053577 | | 3/2009 |
| JP | 2009-210721 | | 9/2009 |

* cited by examiner

*Primary Examiner* — Susan Lee
(74) *Attorney, Agent, or Firm* — Renner, Otto, Boisselle & Sklar, LLP

(57) ABSTRACT

A toner cartridge includes a container body and a screw conveyer section. The screw conveyer section includes a rotation shaft and a toner conveying blade. The toner rotation shaft includes a first rotation shaft portion and a second rotation shaft portion concentrically communicated to the first rotation shaft portion and having a diameter smaller than that of the first rotation shaft portion. The toner conveying blade includes a first blade portion formed on the first rotation shaft portion, and a second blade portion formed on the second rotation shaft portion, a period of a spiral of the second blade portion winding around the second rotation shaft portion being smaller than a period of a spiral of the first blade portion winding around the first rotation shaft portion.

5 Claims, 5 Drawing Sheets

TONER CARTRIDGE, IMAGE FORMING APPARATUS AND IMAGE FORMING METHOD

CROSS-REFERENCE TO RELATED APPLICATION

This application claims priority to Japanese Patent Application No. 2009-232892, which was filed on Oct. 6, 2009, the content of which is incorporated herein by reference in its entirety.

BACKGROUND OF THE INVENTION

1. Field of the Invention

The present invention relates to a toner cartridge, an image forming apparatus equipped with the toner cartridge, and an image forming method.

2. Description of the Related Art

A toner cartridge containing a toner for use in printing processing is detachably attached to electrophotographic image forming apparatuses such as a laser printer, a copying machine and a multifunctional peripheral. When printing processing is performed in the image forming apparatus, a toner in the toner cartridge is gradually consumed. When the cartridge becomes empty, the used and empty cartridge is exchanged for a toner cartridge having a toner filled therein.

The cartridge is a rectangular parallelepiped in appearance, and comprises a container body having a toner containing space for containing a toner, and a toner conveying screw provided in the container body. The toner conveying screw is provided with a spiral toner conveying blade on a rotation shaft extending in parallel in a longitudinal direction of the container body, and conveys the toner in the container body toward a toner discharge port by rotating the rotation shaft about an axis thereof. The toner conveyed is discharged from the toner discharge port toward a developing device.

The toner conveying screw is provided so as to have a clearance to an inner wall surface of the container body. When the clearance is set to be small, toner conveying capability by the toner conveying screw can be improved.

However, in the cartridge in which the clearance is set small, when the toner conveying screw rotates, friction force imparted to a toner entered the clearance is increased, and as a result, toner aggregation occurs in the state that toner particles are packed with each other. The toner aggregated in the packed state decreases chargeability, and this gives rise to the problem that the toner is not charged in an appropriate charged amount in a developing device, resulting in deterioration of quality of an image printed.

To overcome such a problem, Japanese Unexamined Patent Publication JP-A 2004-334054 discloses a toner cartridge having a toner conveying screw, in which an outer diameter of a spiral blade is formed locally small, a period of the spiral (pitch) of the spiral blade is set small, or an outer diameter of a spiral blade is formed locally small and a period of the spiral (pitch) of the spiral blade is set small. According to the toner cartridge disclosed in JP-A 2004-334054, the friction force imparted to a toner entered a clearance between the toner conveying screw and an inner wall surface of a container body is reduced by locally reducing conveying capability of the toner conveying screw, thereby occurrence of toner aggregation can be inhibited.

However, in the toner cartridge disclosed in JP-A 2004-334054, even though occurrence of toner aggregation can be inhibited, toner conveying capability by the toner conveying screw is decreased, resulting in decrease in toner replenishing capability to a developing device.

SUMMARY OF THE INVENTION

One object of the invention is to provide a toner cartridge capable of maintaining high toner replenishing capability to a developing device and inhibiting occurrence of toner aggregation. Another object of the invention is to provide an image forming apparatus. Still another object of the invention is to provide an image forming method.

The invention provides a toner cartridge comprising a container body having a toner containing space for containing a toner, and a screw conveyer section provided in the toner containing space of the container body, for conveying the toner toward a toner discharge part for discharging the toner, the screw conveyer section comprising a rotation shaft having a rotation axis in parallel with a conveying direction of a toner, and a spiral toner conveying blade provided on the rotation shaft, the rotation shaft including a first rotation shaft portion, and a second rotation shaft portion concentrically continuing from the first rotation shaft portion and having a diameter smaller than that of the first rotation shaft portion, the toner conveying blade including a first blade portion formed on the first rotation shaft portion, and a second blade portion formed on the second rotation shaft portion, a period of the spiral of the second blade portion winding around the second rotation shaft portion of the rotation shaft being smaller than a period of the spiral of the first blade portion winding around the first rotation shaft portion of the rotation shaft.

According to the invention, the toner cartridge comprises a container body having a toner containing space for containing a toner, and a screw conveyer section provided in the toner containing space of the container body, for conveying the toner toward a toner discharge part for discharging the toner. The screw conveyer section comprises a rotation shaft having a rotation axis in parallel with a conveying direction of a toner, and a spiral toner conveying blade provided on the rotation shaft. The rotation shaft includes a first rotation shaft portion, and a second rotation shaft portion concentrically continuing from the first rotation shaft portion and having a diameter smaller than that of the first rotation shaft portion. The toner conveying blade includes a first blade portion formed on the first rotation shaft portion, and a second blade portion formed on the second rotation shaft portion, a period of the spiral of the second blade portion winding around the second rotation shaft portion of the rotation shaft being smaller than a period of the spiral of the first blade portion winding around the first rotation shaft portion of the rotation shaft.

In the rotation shaft of the screw conveyer section for conveying a toner, the second rotation shaft portion has a diameter smaller than that of the first rotation shaft portion. Therefore, the second rotation shaft portion constitutes a portion having stiffness lower than that of the first rotation shaft portion. In other words, the rotation shaft comprises a high stiffness region corresponding to the first rotation shaft portion relative and a low stiffness region corresponding to the second rotation shaft portion, with respect to a direction in which the rotation axis of the rotation shaft extends. In the screw conveyer section having such a rotation shaft, when the second blade portion formed on the second rotation shaft portion comes into contact with a toner entered a clearance between the second blade portion and an inner wall surface of the container body, the second rotation shaft portion becomes the state warped in a direction perpendicular to a direction in which the rotation axis of the rotation shaft extends. Due to this, when the rotation shaft is rotated, the screw conveyer section can decrease friction force imparted to a toner entered a clearance between the second blade portion formed on the second rotation shaft portion and an inner wall surface of the container body. As a result, the toner cartridge can inhibit occurrence of toner aggregation that toners aggregate in a packed state.

The second blade portion is formed on the second rotation shaft portion with a period of the spiral smaller than a period of the spiral of the first blade portion. Therefore, even though stiffness of the second rotation shaft portion is lower than that of the first rotation shaft portion, the second rotation shaft portion can have high toner conveying capability similar to that of the first blade portion. As a result, a toner cartridge that maintains toner replenishing capability to a developing section in high state, and additionally can inhibit toner aggregation can be achieved.

Further in the invention, it is preferable that the first rotation shaft portion faces the toner discharge part.

According to the invention, the first rotation shaft portion of the rotation shaft faces the toner discharge part. In the toner cartridge, the toner discharge part is a part on which a toner conveyed by the screw conveyer section is accumulated. Therefore, a toner retention amount in the direction in which the rotation axis of the rotation shaft extends is increased in the vicinity of the toner discharge part. In the toner cartridge according to the invention, the first rotation shaft portion is provided facing the toner discharge portion having a large toner retention amount. The first rotation shaft portion is a portion of a high stiffness region in the rotation shaft. Therefore, even where the toner retention amount is large, the first rotation shaft portion can smoothly discharge the toner from the toner discharge part without warping in a direction perpendicular to the direction in which the rotation axis of the rotation shaft extends. As a result, the toner cartridge is that toner replenishing capability to a developing section is maintained in high state.

Further in the invention, it is preferable that the screw conveyer section comprises a transmission section for transmitting a driving force that rotates the rotation shaft, and the transmission section is connected to the first rotation shaft portion.

According to the invention, the screw conveyer section comprises a transmission section for transmitting a driving force that rotates the rotation shaft, and the transmission section is connected to the first rotation shaft portion. The first rotation shaft portion is a portion of a high stiffness region in the rotation shaft. Therefore, even where the transmission section is connected to the first rotation shaft portion, the first rotation shaft part can stably transmit a driving force to the rotation shaft without warping in a direction perpendicular to the direction in which the rotation axis of the rotation shaft extends. As a result, toner conveying capability of the toner conveying blade can stably be maintained in high state, and toner replenishing capability to a developing section is maintained in high state.

Further, the invention provides an image forming apparatus comprising a photoreceptor on which an electrostatic latent image is to be formed, a developing section for feeding a toner to the photoreceptor and developing the electrostatic latent image, and a toner replenishing section for replenishing a toner to the developing section, the toner replenishing section comprising the toner cartridge mentioned above.

According to the invention, the image forming apparatus comprising a photoreceptor on which an electrostatic latent image is to be formed, a developing section for feeding a toner to the photoreceptor and developing the electrostatic latent image, and a toner replenishing section for replenishing a toner to the developing section, the toner replenishing section comprising the toner cartridge mentioned above. The toner cartridge of the invention is that toner replenishing capability to the developing section is maintained in high state, and additionally, toner aggregation can be inhibited. Therefore, the image forming apparatus can respond to a high speed process having high toner consumption rate, and additionally, can form high definition image.

Further in the invention, it is preferable that the image forming apparatus further comprises a guide section for leading a toner discharged from the toner discharge part of the toner cartridge to the developing section, and the guide section includes a communicating guide part having a communicating space which is a communicating space opened at both sides in a vertical direction, through which communicating space the toner passes toward the developing section from the toner discharge part.

According to the invention, the image forming apparatus further comprises a guide section for leading a toner discharged from the toner discharge part of the toner cartridge to the developing section, and the guide section includes a communicating guide part having a communicating space which is a communicating space opened at both sides in a vertical direction, through which communicating space the toner passes toward the developing section from the toner discharge part. This constitution makes it possible to stably feed the toner discharged from the toner discharge part to the developing section without clogging, and therefore, toner replenishing capability to the developing section is stably maintained in high state. As a result, the image forming apparatus can respond to a high speed process having high toner consumption rate.

Further, the invention provides an image forming method comprising forming an image using the image forming apparatus mentioned above.

According to the invention, the image forming method forms an image using the image forming apparatus of the invention. The image forming apparatus of the invention can stably feed a toner free of toner aggregation to the developing section. Therefore, the image forming method can respond to a high speed process having high toner consumption rate, and additionally, can stably form a high definition image over a long period of time.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
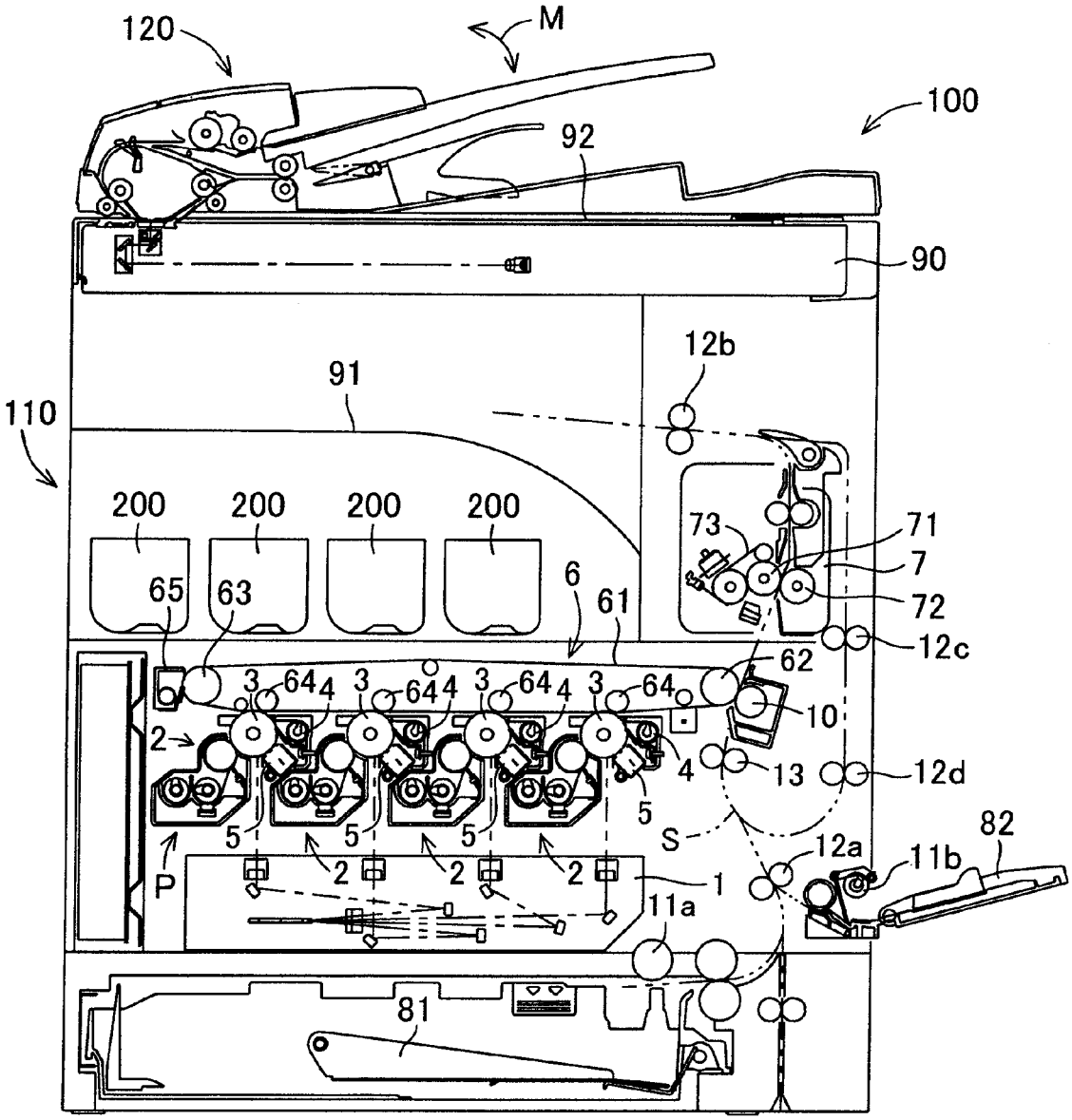
FIG. 1 is a view schematically showing the constitution of an image forming apparatus having a toner cartridge of an embodiment mounted therein.

Now referring to the drawings, preferred embodiments of the invention are described below.

FIG. 1 is a view schematically showing the constitution of an image forming apparatus 100 having a toner cartridge 200 of an embodiment mounted therein. The image forming apparatus 100 having the toner cartridge 200 of the embodiment mounted therein is described below. The image forming apparatus 100 is an apparatus for forming a multicolor or single color image to a recording paper sheet as a recording medium based on image data transmitted from the outside or image data obtained by document reading, and comprises an apparatus main body 110 and an automatic document processor 120.

The apparatus main body 110 comprises an exposure unit 1; four image formation stations P; an intermediate transfer unit 6 comprising an intermediate transfer belt 61; a fixing unit 7; an internal paper feeding unit 81; a manual paper feeding unit 82; and a paper discharge unit 91. A document platen 92 made of transparent glass, for placing a document thereon is provided in an upper part of the apparatus main body 110, and the automatic document processor 120 is provided at an upper side of the document platen 92. The automatic document processor 120 automatically conveys a document on the document platen 92. The automatic document processor 120 is constituted rotatably in a direction of arrow M, and is constituted such that a document can manually be placed on the document platen 92 by opening a surface of the document platen 92.

The image forming apparatus 100 performs image formation in the image formation stations P using image data corresponding to each color of four colors: black (K), as well as cyan (C), magenta (M) and yellow (Y) that are three primary colors of subtractive mixture obtained by color separation of a color image. The four image formation stations P are arranged in line in a movement direction (rotation direction) of the intermediate transfer belt 61.

The four image formation stations P have the same constitution, respectively, and each comprises a development unit 2 as a developing section, a photoreceptor 3, a cleaner unit 4, a charging device 5 and the toner cartridge 200 according to the invention. The photoreceptor 3 is an image bearing member, and the development unit 2, the cleaner unit 4 and the charging device 5 are arranged around the photoreceptor 3. The development units 2 of the four image formation stations P contain color toner of yellow (Y), magenta (M), cyan (C) and black (K), respectively.

The photoreceptor 3 has a cylindrical drum shape, and rotates about a rotation axis thereof by a drive section (not shown). The photoreceptor 3 comprises a cylindrical conductive substrate and a photosensitive layer provided on a surface of the conductive substrate.

The charging device 5 is arranged so as to face the photoreceptor 3 and separate from a surface of the photoreceptor 3 with a clearance along a direction in which the rotation axis of the photoreceptor 3 extends. The charging device 5 is a charger type device, and uniformly charges the surface of the photoreceptor 3 in a given potential.

The exposure unit 1 is a laser scanning unit (LSU) equipped with a laser emitting part, a reflective mirror and the like. The exposure unit 1 comprises a laser emitting part for emitting laser light modulated according to image data transmitted from the automatic document processor 120 or the outside, a polygon mirror for deflecting laser light emitted from the laser emitting part, a converging lens for converging the laser light deflected in a main scanning direction by the polygon mirror such that the laser light converged by the converging lens forms an image on the surface of the photoreceptor 3, and a reflective mirror for reflecting the laser light converged by the converging lens. The laser light emitted from the laser emitting part is deflected by the polygon mirror, converged by the converging lens, reflected by the reflective mirror, and illuminated onto the surface of the photoreceptor 3 charged in given potential and polarity. Thus, an electrostatic latent image according to image data is formed on the photoreceptor 3. The exposure unit 1 can use the laser scanning unit (LSU) described before, and further can use a writing device (for example, a writing head) having light emitting elements arranged in an array form, such as ELs (Electro Luminescence) and LEDs (Light Emitting Diode).

The development unit 2 is provided so as to face and be in pressure-contact with the photoreceptor 3, and feeds a toner as a developer to an electrostatic latent image formed on the surface of the photoreceptor 3, thereby developing the electrostatic latent image.

The cleaner unit 4 removes and collects a toner remained on the surface of the photoreceptor 3 after development and image transfer.

The toner cartridge 200 replenishes a toner to the development unit 2 in order to respond to toner consumption by development. The toner cartridge 200 is detachably provided in the apparatus main body 110.

The intermediate transfer unit 6 is arranged on the upper side of the photoreceptor 3, and comprises an intermediate transfer belt 61, an intermediate transfer belt driving roller 62, an intermediate transfer belt driven roller 63, a primary transfer roller 64 and an intermediate transfer belt cleaning unit 65.

The intermediate transfer belt 61 is an endless belt member supported around the intermediate transfer belt driving roller 62 and the intermediate transfer belt driven roller 63 with tension to form a loop-like movement path, and has a thickness of from 100 μm to 150 μm. The primary transfer roller 64 is arranged at a position facing the photoreceptor 3 with the intermediate transfer belt 61 interposed therebetween. The position that the intermediate transfer belt 61 faces the photoreceptor 3 is a primary transfer position.

Primary transfer bias having polarity opposite charging polarity of a toner is applied to the primary transfer roller 64 under constant voltage control in order to transfer a toner image borne on the surface of the photoreceptor 3 to the intermediate transfer belt 61. By this, toner images of the respective colors formed on the photoreceptor 3 are transferred and overlaid onto an outer peripheral surface of the intermediate transfer belt 61 sequentially, and a full-color toner image is formed on the outer peripheral surface of the intermediate transfer belt 61. However, where image data of only a part of yellow, magenta, cyan and black colors is inputted, formations of an electrostatic latent image and a toner image are performed in only a part corresponding to the colors of image data inputted of the respective photoreceptors 3 of the four image formation stations P. For example, in the formation of a monochrome image, formation of an electrostatic latent image and formation of a toner image are performed in only the photoreceptor 3 corresponding to black color, and only a black toner image is transferred to the outer peripheral surface of the intermediate transfer belt 61. The primary transfer roller 64 comprises a shaft comprising a metal (for example, stainless steel) having a diameter of from 8 to 10 mm as a material and a conductive elastic material (for example, EPDM: ethylene/propylene copolymer rubber and foamed polyurethane) covering the surface of the shaft, and uniformly applies high voltage to the intermediate transfer belt 61 by the conductive elastic material.

The toner image transferred to the outer peripheral surface of the intermediate transfer belt 61 by the primary transfer roller 64 is conveyed to a second transfer position that is a position facing a secondary transfer roller 10 by the revolution of the intermediate transfer belt 61.

The secondary transfer roller 10 comes into pressure-contact with the outer peripheral surface of the intermediate transfer belt 61 in which an inner peripheral surface thereof comes in contact with a circumferential surface of the intermediate transfer belt driving roller 62, under application of a given nip pressure during the image formation. When a recording paper sheet fed from an internal paper feeding unit 81 or a manual paper feeding unit 82 passes between the secondary transfer roller 10 and the intermediate transfer belt 61, high voltage having polarity opposite the charged polarity of the toner is applied to the secondary transfer roller 10. By this, a toner image is transferred from the outer peripheral surface of the intermediate transfer belt 61 to the surface of the recording paper sheet. To constantly obtain the nip pressure in the secondary transfer position, one of the secondary transfer roller 10 and the intermediate transfer belt driving roller 62 is made of a hard material comprising a metal or the like, and another roller is made of a soft material comprising an elastic rubber, a foamable resin or the like.

Of the toner adhered to the intermediate transfer belt 61 from a part or the whole of the photoreceptor 3, a toner remaining on the intermediate transfer belt 61, that is not transferred to the recording paper sheet, is removed and collected by the intermediate transfer belt cleaning unit 65 in order to prevent color mixing in the subsequent step. The intermediate transfer belt cleaning unit 65 is equipped with a cleaning blade which comes in contact with the intermediate transfer belt 61 and removes a toner.

The fixing unit 7 comprises a heat roller 71 and a pressure roller 72. A recording paper sheet having a toner image transferred thereto is led to the fixing unit 7, and is subjected to heat and pressure by passing between the heating roller 71 and the pressure roller 72. By this, the toner image is firmly fixed to the surface of the recording paper sheet. In the fixing unit 7, the heat roller 71 is provided with an external fixing belt 73 for heating the heat roller 71 from the outside in a contact state. The heat roller 71 is controlled so as to be a given fixing temperature based on temperature data detected by a temperature detector (not shown). The recording paper sheet having a toner image fixed thereto is discharged to the upper side of the paper discharge unit 91 by conveying rollers 12*b*.

The image forming apparatus 100 further comprises a paper conveyance path S extending in nearly vertical direction for sending a recording paper sheet contained in an internal paper feeding unit 81 and a manual paper feeding unit 82 to a paper discharge unit 91 by passing between the secondary transfer roller 10 and the intermediate transfer belt 61, and through the fixing unit 7. Pickup rollers 11*a* and 11*b*, a plurality of conveying rollers 12*a* to 12*d*, and registration rollers 13 are arranged in the vicinity of the paper conveyance path S.

The conveying rollers 12*a* to 12*d* are small-sized rollers for promoting and assisting conveyance of the recording paper sheet, and a plurality of the conveying rollers are provided along the paper conveyance path S. The pickup roller 11*a* is provided in the vicinity of the end of the internal paper feeding unit 81, picks up a recording paper sheet one by one from the internal paper feeding unit 81 and feeds the paper sheet to the paper conveyance path S. The pickup roller 11*b* is provided in the vicinity of the end of the manual paper feeding unit 82, picks up a recording paper sheet one by one from the manual paper feeding unit 82 and feeds the paper sheet to the paper conveyance path S.

The registration rollers 13 are ones temporally hold a recording paper sheet under conveying in the paper conveyance path S. The registration rollers 13 have a function of conveying the recording paper sheet to a region between the secondary transfer roller 10 and the intermediate transfer belt 10 at the timing of matching the leading end of a toner image on the photoreceptor 3 and the leading end of the recording paper sheet.

In the image forming apparatus 100, the recording paper sheet conveyed from the internal paper feeding unit 81 and the manual paper feeding unit 82 is conveyed to the registration rollers 13 by the conveying roller 12*a* in the paper conveyance path S, and conveyed to the secondary transfer roller 10 by the registration rollers 13 at the given timing. When the recording paper sheet passes between the secondary transfer roller 10 and the intermediate transfer belt 61, a toner image is transferred to the recording paper sheet. The recording paper sheet having the toner image transferred thereto passes through the fixing unit 7, thereby the toner image is melted and fixed by heat, and then the recording paper sheet is discharged on the paper discharge unit 91 through the conveying rollers 12*b*.

In the case of double-sided printing that forms images on both sides of a recording paper sheet in the image forming apparatus 100, when one side printing is completed, the recording paper sheet passes through the fixing unit 7 and a tail end of the recording paper sheet is grasped with the conveying rollers 12*b*, the conveying rollers 12*b* inversely rotate, thereby leading the recording paper to the conveying rollers 12*c* and 12*d*. The recording paper sheet led to the conveying rollers 12*c* and 12*d* passes through the registration rollers 13, the secondary transfer roller 10 and the fixing unit 7, printing on the back side of the recording paper sheet is conducted, and the recording paper sheet is then discharged to the paper discharge unit 91.

Constitution of the toner cartridge 200 of the embodiment is described below by reference to the drawing.

Figure 2:
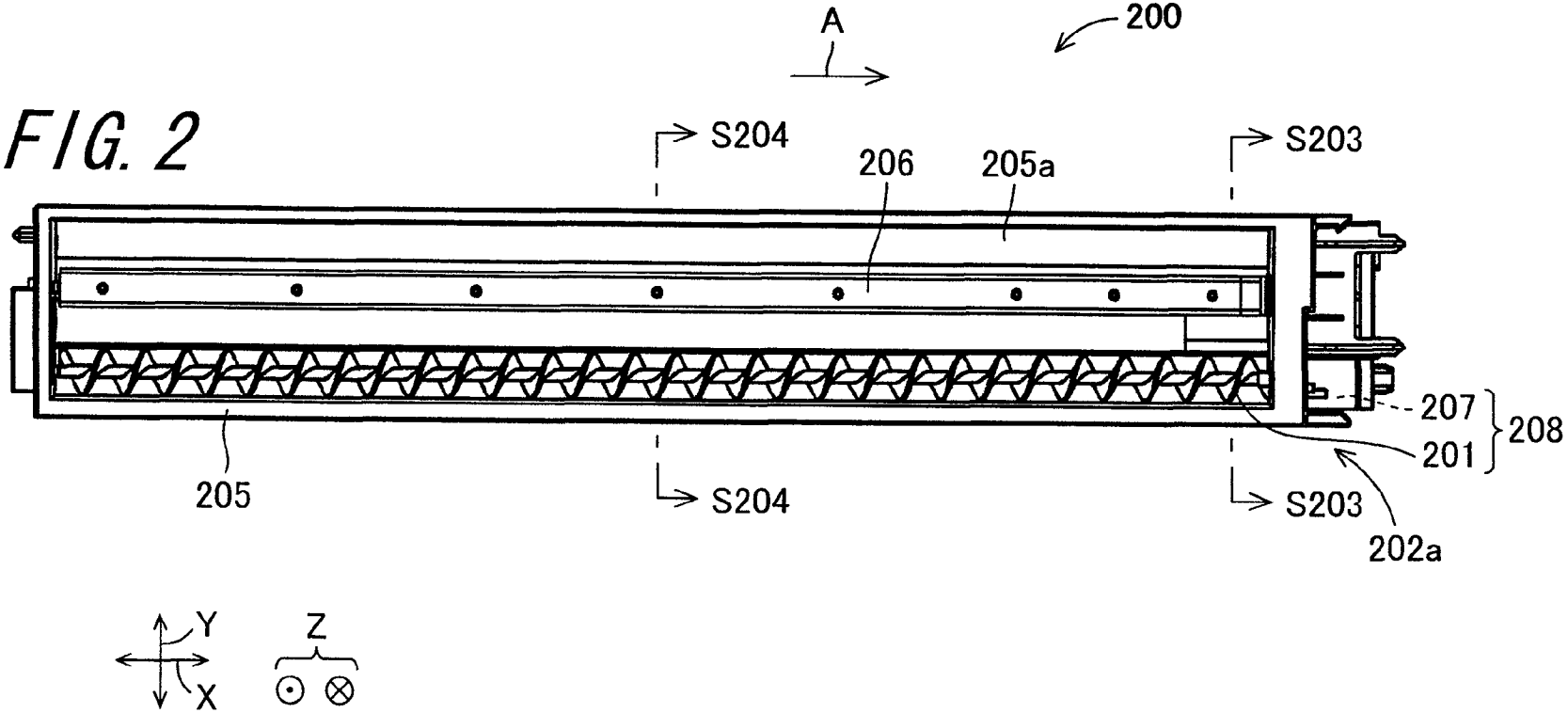
FIG. 2 is a plan view showing the constitution of the toner cartridge.
Figure 3A:
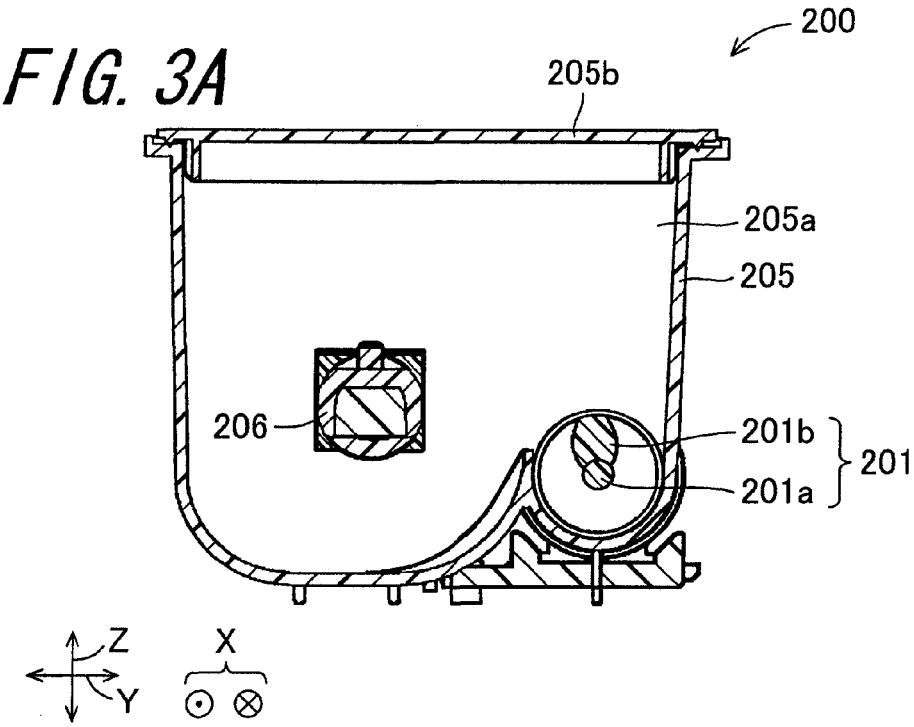
FIGS. 3A and 3B are cross-sectional views of the toner cartridge.
Figure 3B:
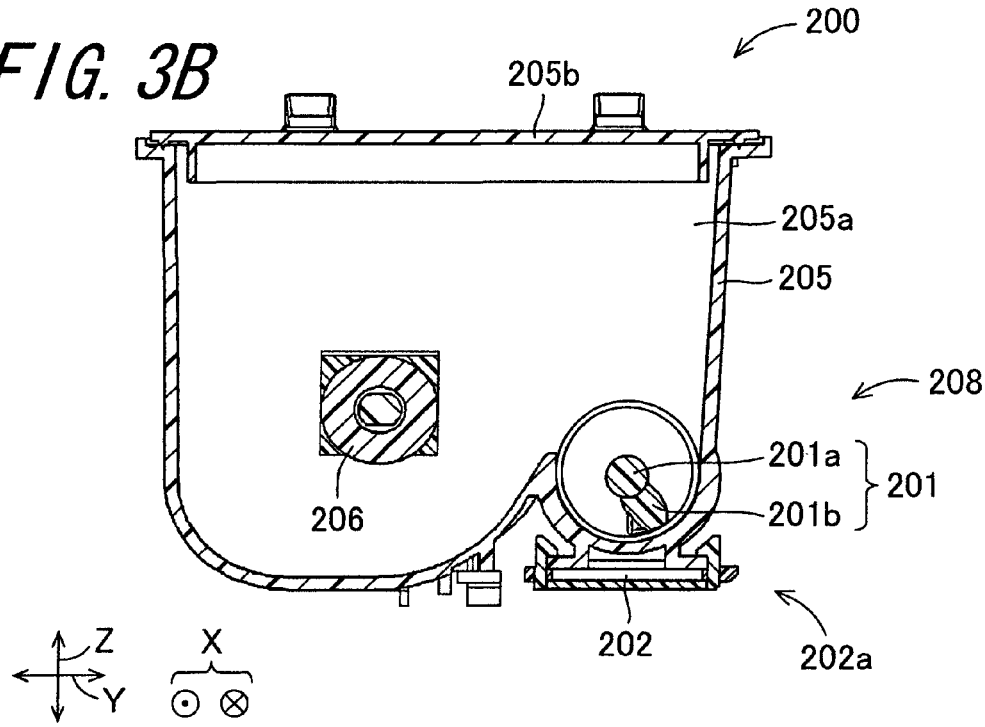

FIG. 2 is a plan view showing the constitution of the toner cartridge 200. FIGS. 3A and 3B are cross-sectional views of the toner cartridge 200. FIG. 3A is a view taken along the line S204-S204 shown in FIG. 2, and FIG. 3B is a cross-sectional view taken along the line S203-S203 shown in FIG. 2. Note that, FIG. 2 is a view showing the state that a lid described hereinafter is removed in order to make the explanation easy.

The toner cartridge 200 comprises a container body 205, a screw conveyer section 208 and a stirring section 206.

The container body 205 is a container-like member formed into a bottomed square cylindrical shape and having a toner containing space 205*a* for containing a toner therein, and is detachably provided with a lid 205*b* so as to cover the opening opened at one side in a height direction Z. A toner discharge part 202*a* for discharging a toner is provided at one side in a longitudinal direction X of the container body 205 and at other end part in a height direction Z (a bottom) thereof. The toner discharge part 202*a* is a through-hole formed so as to penetrate the bottom of the container body 205, and includes a toner discharge port 202 for discharging a toner to the development unit 2 outside the container body 205. FIG. 3B is a cross-sectional view of the toner cartridge 200 in a place at which the toner discharge port 202 is formed.

The screw conveyer section 208 comprises a toner conveying screw part 201 and a transmission part 207. The toner conveying screw part 201 is a member that conveys a toner in a direction of arrow A (parallel to the longitudinal direction X of the container body 205) toward the toner discharge part

202*a* while stirring a toner in the toner containing space 205*a* by rotation, and comprises a rotation shaft 201*a* and a toner conveying blade 201*b*. The rotation shaft 201*a* is a columnar member extending in parallel to the longitudinal direction X of the container body 205, and rotates about a rotation axis thereof parallel to the toner conveying direction A. The toner conveying blade 201*b* is a spiral member provided so as to continue outwardly in a radial direction from the surface of the rotation shaft 201*a*. In the embodiment, a material of the toner conveying screw part 201 is polystyrene.

The stirring section 206 is a rod-like member having projected portions on the surface thereof, provided with intervals in a width direction X of the container body 205 with respect to the toner conveying screw part 201 in the toner containing space 205*a*, and rotates about a rotation axis thereof parallel to the toner conveying direction A. When the stirring section 206 rotates, a toner in the toner containing space 205*a* is stirred, and the toner stirred in the stirring section 206 is sent to the circumference of the toner conveying screw part 201.

The transmission part 207 being a transmission section is provided connecting to the rotation shaft 201*a* in the outside of the container body 205 from one end in the longitudinal direction X of the container body 205, and transmits a driving force for rotating the rotation shaft 201*a* to the rotation shaft 201*a*. The transmission part 207 transmits a driving force from a driving source (for example, a motor) (not shown) of the image forming apparatus 100 to the rotation shaft 201*a*.

Figure 4:
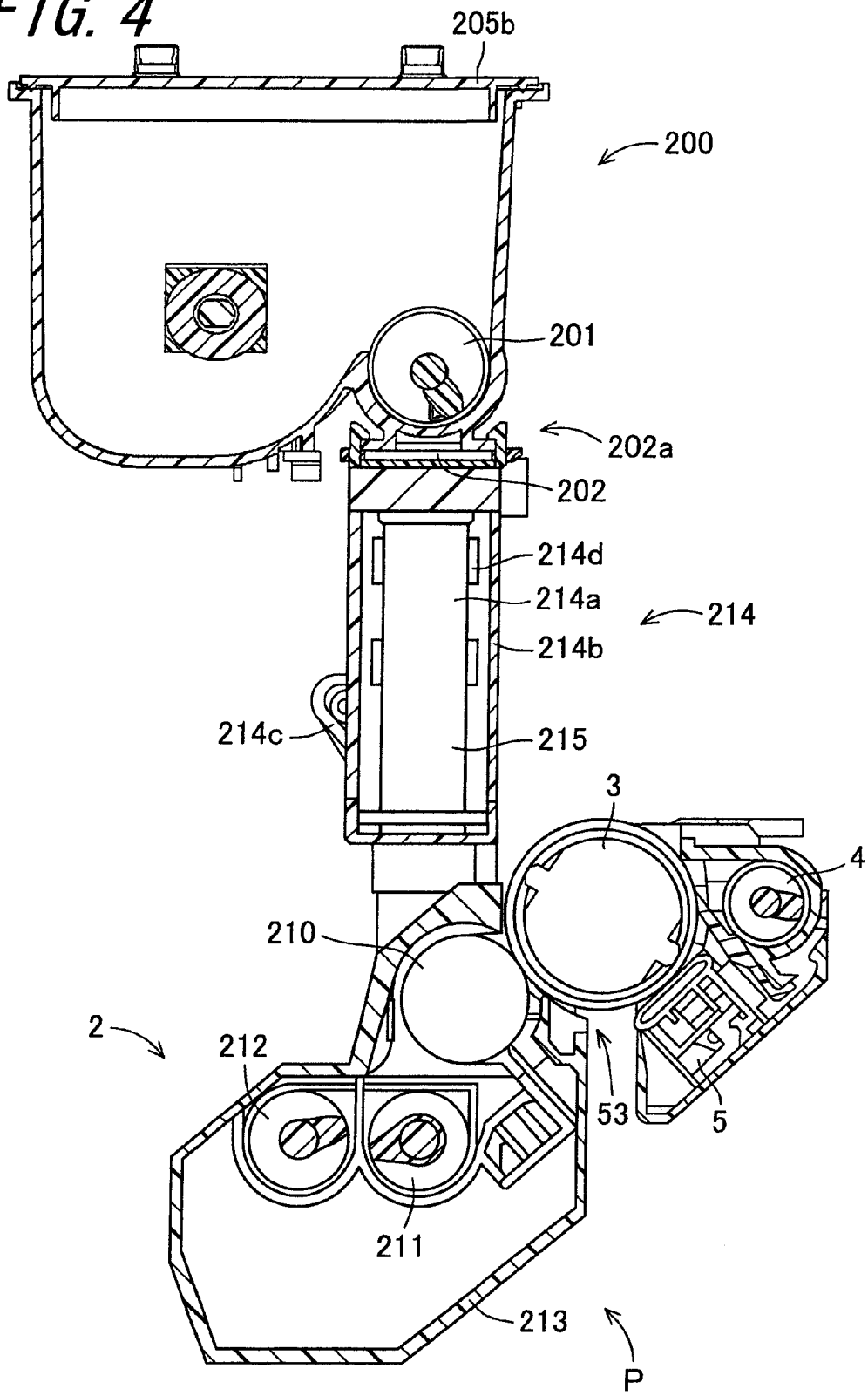
FIG. 4 is a view schematically showing a connection state between the toner cartridge and a development unit.

FIG. 4 is a view schematically showing a connection state between the toner cartridge 200 and the development unit 2. The development unit 2 comprises a developer tank 213, a developing roller 210, a feeding roller 211, a stirring roller 212, and a toner replenishing port (not shown). The developer tank 213 is a container-like member that is provided so as to face the surface of the photoreceptor 3, feeds a toner to an electrostatic latent image formed on the surface of the photoreceptor 3 to develop the electrostatic latent image, and forms a toner image as a visual image. The developer tank 213 contains a toner in its inner space, contains roller members such as the developing roller 210, the feeding roller 211 and the stirring roller, and rotatably supports those members.

An opening 53 is formed on a side of the developer tank 213 facing the photoreceptor 3, and the developing roller 210 is rotatably provided at a position facing the photoreceptor 3 through the opening 53. The developing roller 210 is a roller-like member that feeds a toner to an electrostatic latent image on the surface of the photoreceptor 3 in a pressure-contact part or the closest part to the photoreceptor 3. In feeding a toner, potential having polarity opposite the charged potential of a toner is applied as developing bias voltage (hereinafter simply referred to as "developing bias") to the surface of the developing roller 210. By this, the toner on the surface of the developing roller 210 smoothly fed to the electrostatic latent image on the surface of the photoreceptor 3. Furthermore, an amount of a toner fed to the electrostatic latent image, that is, a toner attachment amount of the electrostatic latent image, can be controlled by changing the developing bias value.

The feeding roller 211 is a roller-like member rotatably provided facing the developing roller 210, and feeds a toner to the circumference of the developing roller 210.

The stirring roller 212 is a roller-like member rotatably provided facing the feeding roller 211, and sends a toner freshly replenished in the developer tank 213 from the toner cartridge 200 to the circumference of the feeding roller 211.

A guide section 214 is provided between the toner cartridge 200 and the development unit 2. The guide section 214 leads a toner discharged from the toner discharge part 202*a* of the toner cartridge 200 to the development unit 2, and comprises a communicating guide part 214*a* and a surrounding member 214*b*. The communicating guide part 214*a* is open on both sides in a vertical direction, and has a communicating space 215 through which a toner replenished to the development unit 2 depending on toner consumption state in the development unit 2 passed toward the development unit 2 from the toner discharge part 202*a*. The communicating guide part 214*a* is formed into a cylindrical shape, wherein one end thereof in vertical direction is connected to the toner discharge port 202 of the toner cartridge 200, and other end in vertical direction is connected to a toner replenishment port provided at a position corresponding to the upper part in a vertical direction of the stirring roller 212 in the developer tank 213. The communicating guide part 214*a* has a structure to oscillate in vertical direction in order to prevent a toner from clogging in a communicating space 215. The communicating guide part 214*a* is guided by a guide part 214*d* to oscillate. The surrounding member 214*b* is a member provided so as to cover the communicating guide part 214*a*, and is fixed by a screw fixing part 214*c*.

When the guide section 214 comprises the communicating guide part 214*a* having the communicating space 215 which is a communicating space 215 which is open on both sides in a vertical direction, through which communicating space a toner passes toward the development unit 2 from the toner discharge part 202*a*, the toner discharged from the toner discharge part 202*a* is stably fed to the development unit 2 without clogging. Therefore, toner replenishing capability to the development unit 2 is stably maintained in high state. As a result, the image forming apparatus 100 can respond to high speed process having high toner consumption rate.

In the toner cartridge 200, a toner conveyed to the toner discharge part 202*a* by the toner conveying screw part 201 and discharged from the toner discharge port 202 flows and passes through the communicating guide part 214*a*, and is replenished in the developer tank 213 though a toner replenishment port. The toner replenished toward the stirring roller 212 from the toner replenishment port is stirred by the stirring roller 212, charged, conveyed to the developing roller 210 through the feeding roller 211 and develops an electrostatic latent image on the surface of the photoreceptor 3, thereby forming a toner image.

The toner cartridge 200 of the embodiment is described in more detail below with reference to FIG. 5.

Figure 5:
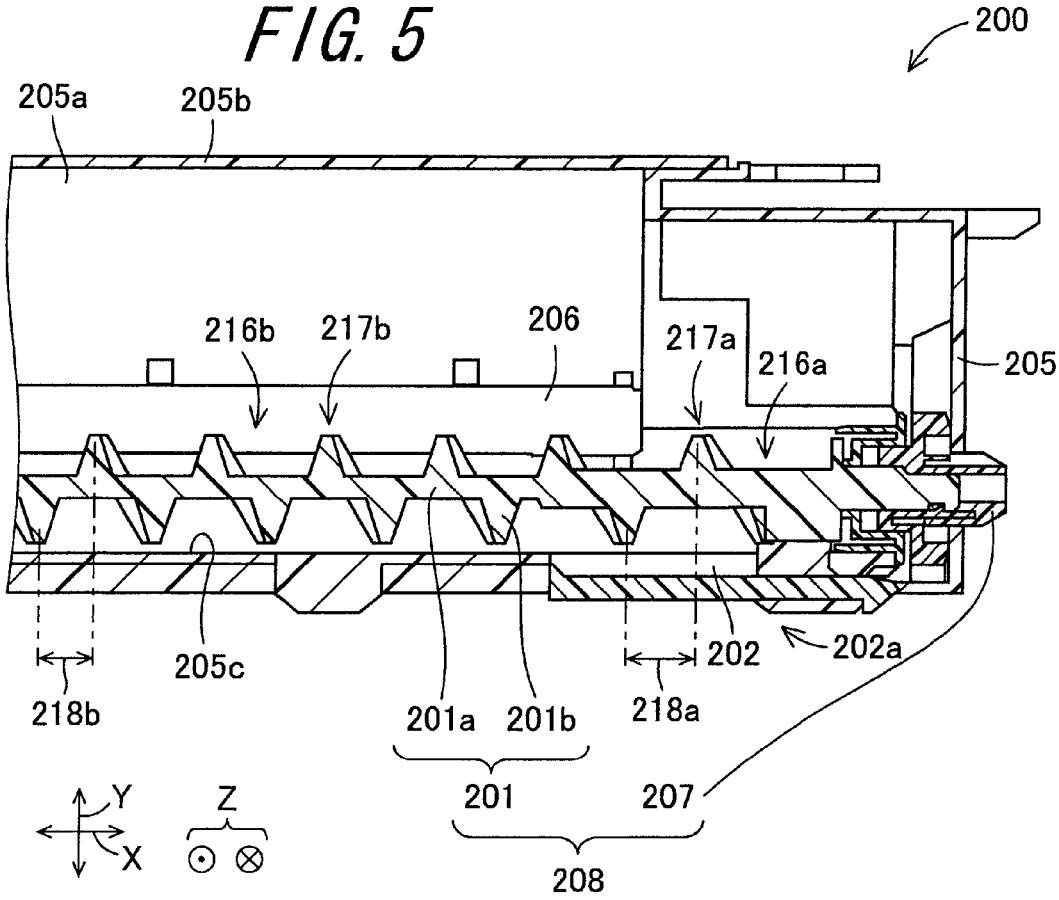
FIG. 5 is an enlarged view of the circumference of a toner discharge part in the toner cartridge taken along the line S203-S203 shown in FIG. 2.

FIG. 5 is an enlarged view of the circumference of the toner discharge part 202*a* in the toner cartridge 200 taken along the line S203-S203 shown in FIG. 2. As shown in FIG. 5, the rotation shaft 201*a* of the screw conveyer section 208 does not have a constant shaft diameter in a longitudinal direction X of the container body 205, and comprises a first rotation shaft portion 216*a* and a second rotation shaft portion 216*b* having a diameter smaller than that of the first rotation shaft portion 216*a*. The first rotation shaft portion 216*a* and the second rotation shaft portion 216*b* are concentrically communicated, and a shaft center of the first rotation shaft portion 216*a* and a shaft center of the second rotation shaft portion 216*b* are the same. A first blade portion 217*a* is formed on the first rotation shaft portion 216*a*, and a second blade portion 217*b* is formed on the second rotation shaft portion 216*b*.

In the rotation shaft 201*a*, the second rotation shaft portion 216*b* has a diameter smaller than that of the first rotation shaft portion 216*a*, and therefore becomes a portion having stiffness lower than that of the first rotation shaft portion 216*a*. Specifically, the rotation shaft 201*a* has a high stiffness region corresponding to the first rotation shaft portion 216*a* and a low stiffness region corresponding to the second rotation shaft portion 216*b*, with respect to a direction in which the rotation axis thereof extends. In the screw conveyer section 208 having the rotation shaft 201*a* as above, when the second blade portion 217*b* formed on the second rotation shaft portion 216*b* becomes in contact with a toner entered a clearance between the second blade portion 217*b* and an inner wall surface 205*c* of the container body 205, the second rotation shaft portion 216*b* becomes a state of warping in a direction perpendicular to the direction in which the rotation axis thereof extends. As a result, in the screw conveyer section 208, when the rotation shaft 201*a* rotates, friction force given to a toner entered a clearance between the second blade portion 217*b* formed on the second rotation shaft portion 216*b* and the inner wall surface 205*c* of the container body 205 can be reduced. This permits the toner cartridge 200 to inhibit occurrence of toner aggregation that toners are aggregated in a packed state.

In the embodiment, a period of the spiral (pitch) 218*b* of the second blade portion 217*b* winding around the second rotation shaft portion 216*b* is smaller than a period of the spiral (pitch) 218*a* of the first blade portion 217*a* winding around the first rotation shaft portion 216*a*. Thus, when the second blade portion 217*b* is formed on the second rotation shaft portion 216*b* with the pitch 218*b* smaller than the pitch 218*a* of the first blade portion 217*a*, the second rotation shaft portion 216*b* can have high toner conveying capability as same as in the first blade portion 217*a* even though the second rotation shaft portion 216*b* has stiffness lower than that of the first rotation shaft portion 216*a*. Therefore, the toner cartridge 200 that maintains toner replenishing capability to the development unit 2 in high state and additionally can inhibit toner aggregation can be achieved.

In the embodiment, the first rotation shaft portion 216*a* of the rotation shaft 201*a* faces the toner discharge part 202*a*. In the toner cartridge 200, the toner discharge part 202*a* is a part on which a toner conveyed by the screw conveyer section 208 accumulates. For this reason, the toner retention amount in a direction in which the rotation axis of the rotation shaft 201*a* extends is large in the vicinity of the toner discharge part 202*a*. In the toner cartridge 200, the first rotation shaft portion 216*a* is provided facing the toner discharge part 202*a* having a large toner retention amount, and the first rotation shaft portion 216*a* is a portion of a high stiffness region in the rotation shaft 201*a*. Therefore, even where the toner retention amount is large, the first rotation shaft portion 216*a* can smoothly discharge a toner from the toner discharge part 202*a* without warping in a direction perpendicular to a direction in which the rotation axis of the rotation shaft extends. As a result, the toner cartridge 200 can maintain toner replenishing capability to the development unit 2 in high state.

In the embodiment, the transmission part 207 is connected to the first rotation shaft portion 216*a*. The first rotation shaft portion 216*a* is a portion of a high stiffness region in the rotation shaft 201*a*. Therefore, even where the transmission part 207 is connected to the first rotation shaft portion 216*a*, the first rotation shaft portion 216*a* can stably transmit a driving force to the rotation shaft 201*a* without warping in a direction perpendicular to a direction in which the rotation axis of the rotation shaft extends. As a result, toner conveying capability of the toner conveying blade 201*b* can stably be maintained in high state, and toner replenishing capability to the development unit 2 can stably be maintained in high state.

In the embodiment, the toner discharge part 202*a* is formed at one side in longitudinal direction X of the container body 205, and the transmission part 207 is provided in the outside of the container body 205 from one end in longitudinal direction X of the container body 205. Therefore, the first rotation shaft portion 216*a* is provided at only a position facing the toner discharge part 202*a*. However, the invention is not limited to this embodiment. For example, where the toner discharge part 202*a* is formed at other side in longitudinal direction X of the container body 205, and the transmission part 207 is provided in the outside of the container body 205 from one end in longitudinal direction X of the container body 205, the first rotation shaft portion is provided at a position facing the toner discharge part 202*a* formed at other side in longitudinal direction X of the container body 205 and at one side in longitudinal direction X of the container body 205. In other words, the first rotation shaft portion is provided in both directions in which the rotation axis of the rotation shaft extends.

Designing of the toner conveying screw part 201 of the screw conveyer section 208 in the toner cartridge 200 is described below by indicating specific numerical values.

In the toner cartridge 200, a toner conveying amount by the toner conveying screw part 201 is set to from 9 g/min to 15 g/min (for example, 11 g/min), and a toner discharge amount discharged from the toner discharge part 202*a* is set to from 9 g/min to 15 g/min (for example, 11 g/min).

To achieve the set values of the toner conveying amount and the toner discharge amount, a length (shaft length) of the rotation shaft 201*a* in a direction in which the rotation axis thereof extends is set to from 35 cm to 45 cm (for example, 40 cm). Where the shaft length of the rotation shaft 201*a* exceeds 45 cm, when the second blade portion 217*b* formed on the second rotation shaft portion 216*b* becomes in contact with a toner entered a clearance between the second blade portion 217*b* and the inner wall surface 205*c* of the container body 205, the second rotation shaft portion 216*b* excessively warps in a direction perpendicular to the direction in which the rotation axis of the rotation shaft extends, and as a result, a toner may not smoothly be conveyed to the toner discharge part 202*a*. Where the shaft length of the rotation shaft 201*a* is smaller than 35 cm, a volume of the toner cartridge is decreased, and the toner cartridge 200 cannot contain a sufficient amount of a toner.

Area of the toner discharge port 202 in the toner discharge part 202*a* is set to from 0.6 $cm^2$ to 1.2 $cm^2$ (for example, 0.8 $cm^2$), and the number of revolution of the rotation shaft 201*a* is set to from 15 rpm to 20 rpm (for example, 17 rpm).

The minimum clearance width between the toner conveying screw part 201 and the inner wall surface 205*c* of the container body 205 is limited to from 0.1 mm to 0.4 mm (for example, 0.2 mm). Width of a clearance between the first blade portion 217*a* formed on the first rotation shaft portion 216*a* and width of a clearance between the second blade portion 217*b* formed on the second rotation shaft portion 216*b* and the inner wall surface 205*c* of the container body 205 are the same width. Shaft diameter of the first rotation shaft portion 216*a* differs from that of second rotation shaft portion 216*b*. Therefore, the above widths of the clearances have the same width by adjusting an outer diameter of the first blade portion 217*a* and an outer diameter of the second blade portion 217*b*.

When the minimum clearance width between the toner conveying screw part 201 and the inner wall surface 205*c* of the container body 205 is limited to the above range, the desired toner conveying amount can be achieved, and additionally, the amount of residual toner that is not discharged from the container body 205 and remains in the container body 205 can be reduced.

The residual toner is generated by that the toner enters a clearance between the toner conveying blade 201*b* and the inner wall surface 205*c* of the container body 205 and is not conveyed by the toner conveying screw part 201. In view of this, when clearance width between a toner conveying blade and an inner wall surface of a container body is decreased in the conventional toner cartridge, the residual toner amount can be reduced.

However, when the clearance width is set to the above range, strong friction force is given to a toner entered the clearance. Therefore, toner aggregation that toners aggregate in a packed state occurs. The aggregated toners decrease chargeability in the development unit 2, resulting in deterioration of quality of an image formed.

In view of the above, in the toner cartridge 200 of the embodiment, the rotation shaft 201*a* and the toner conveying blade 201*b*, constituting the toner conveying screw part 201 are set as follows.

Specifically, in the rotation shaft 201*a* having the first rotation shaft portion 216*a* and the second rotation shaft portion 216*b*, a shaft diameter of the first rotation shaft portion 216*a* is set to from 4.5 mm to 6 mm (for example, 5 mm), a shaft diameter of the second rotation shaft portion 216*b* is set to from 2 mm to 4 mm (for example, 3 mitt), and a shaft diameter of the second rotation shaft portion 216*b* is set to 80% or less (preferably 75%) of a shaft diameter of the first rotation shaft portion 216*a*. Furthermore, length of the first rotation shaft portion 216*a* in the direction in which the rotation axis of the rotation shaft extends is set to from 5% to 15% (for example, 10%) of a length of the second rotation shaft portion 216*b* in the direction in which the rotation axis of the rotation shaft.

An outer diameter of the toner conveying screw part 201, that is, a rotation diameter of a tip in a radial direction of the toner conveying blade 201*b*, is set to from 16.2 mm to 16.8 mm (for example, 16.6 mm). The pitch 218*a* of the first blade portion 217*a* with respect to the rotation axis of the rotation shaft and the pitch 218*b* of the second blade portion 217*b* with respect to the rotation axis of the rotation shaft are determined as follows to a shaft diameter of each of the rotation shaft portions 216*a* and 216*b* such that conveying speed of a toner in the direction in the rotation axis of the rotation shaft 201*a* extends becomes uniform in the first rotation shaft portion 216*a* and the second rotation shaft portion 216*b*.

The pitch 218*a* of the first blade portion 217*a* and the pitch 218*b* of the second blade portion 217*b* can be calculated based on an effective screw cross-sectional area in the toner conveying screw part 201.

When an outer diameter of the toner conveying screw part 201 is R, a shaft diameter of the first rotation shaft portion 216*a* is r1, and a shaft diameter of the second rotation shaft portion 216*b* is r2, the effective screw cross-sectional area S1 of the first rotation shaft portion 216*a* in the toner conveying screw part 201 is represented by the following expression (1).

$$S1 = \left(\frac{R}{2}\right)^2 \pi - \left(\frac{r1}{2}\right)^2 \pi \tag{1}$$

The effective screw cross-sectional area S2 of the second rotation shaft portion 216*b* in the toner conveying screw part 201 is represented by the following expression (2).

$$S2 = \left(\frac{R}{2}\right)^2 \pi - \left(\frac{r2}{2}\right)^2 \pi \tag{2}$$

When the pitch 218*a* of the first blade portion 217*a* is P1, and the pitch 218*b* of the second blade portion 217*b* is P2, P1 and P2 are set so as to satisfy the following expression (3) using S1 and S2 obtained as above.

$$P1 \times S1 = P2 \times S2 \tag{3}$$

For example, when R is 16.6 mm, r1 is 5 mm and r2 is 3 mm, S1 is 196.8 $mm^2$ and 52 is 209.4 $mm^2$. When P1 is 15 mm, P2 is 14 mm.

That is, when the pitch 218*a* of the first blade portion 217*a* of the first rotation shaft portion 216*a* having a shaft diameter of 5 mm is 15 mm, the pitch 218*b* of the second blade portion 217*b* of the second rotation shaft portion 216*a* having a shaft diameter of 3 mm is 14 mm.

In the embodiment, the rotation shaft 201*a* having high stiffness region and low stiffness region was prepared by constituting the first rotation shaft portion 216*a* and the second rotation shaft portion 216*b* with the same material in the rotation shaft 201*a* having the first rotation shaft portion 216*a* and the second rotation shaft portion 216*b*, and setting such that the rotation shaft portions 216*a* and 216*b* have different shaft diameter. However, the invention is not limited to this embodiment. The rotation shaft 201*a* may be constituted to have the first rotation shaft portion 216*a* and the second rotation shaft portion 216*b* having a diameter smaller than that of the first rotation shaft portion 216*a*, wherein the second rotation shaft portion 216*b* is constituted of a material having stiffness lower than that of a material constituting the first rotation shaft portion 216*a*.

The rotation shaft 201*a* may be formed such that a connection portion between the first rotation shaft portion 216*a* and the second rotation shaft portion 216*b* is smooth. When the connection portion between the first rotation shaft portion 216*a* and the second rotation shaft portion 216*b* is formed to be smooth, stress does not concentrate on the connecting portion. As a result, the rotation shaft 201*a* itself can be prevented from breaking, and additionally, a toner conveyed to the toner conveying discharge 202*a* by the toner conveying screw part 201 can be prevented from adhering to the connecting portion.

As described above, the toner cartridge 200 having the toner conveying screw part 201 provided in the screw conveyer section 208 can maintain toner replenishing capability to the development unit 2 in high state, and additionally, can inhibit toner aggregation. As a result, the image forming apparatus 100 equipped with the toner cartridge 200 can respond to high speed process having high toner consumption rate, and additionally, can form a high definition image.

In the image forming method forming an image using the image forming apparatus 100, the image forming apparatus 100 can stably feed a toner free of tone aggregation to the development unit 2. As a result, the image forming method can respond to high speed process having high toner consumption rate, and additionally, can form a high definition image.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner cartridge comprising a container body having a toner containing space for containing a toner, and a screw conveyer section provided in the toner containing space of the container body, for conveying the toner toward a toner discharge part for discharging the toner, the screw conveyor section facing the toner discharge part, the screw conveyer section comprising a rotation shaft having a rotation axis in parallel with a conveying direction of a toner, and a spiral toner conveying blade provided on the rotation shaft, the rotation shaft including a first rotation shaft portion, and a second rotation shaft portion concentrically continuing from the first rotation shaft portion and having a diameter smaller than that of the first rotation shaft portion, the first rotation shaft portion being provided only at a position facing the toner discharge part, the toner conveying blade including a first blade portion formed on the first rotation shaft portion, and a second blade portion formed on the second rotation shaft portion, a pitch of the second blade portion winding around the second rotation shaft portion of the rotation shaft being smaller than a pitch of the first blade portion winding around the first rotation shaft portion of the rotation shaft, an effective screw cross-sectional area S1 of the first rotation shaft portion in the screw conveyor section being represented by the following expression (1), $$S1 = \left(\frac{R}{2}\right)^2 \pi - \left(\frac{r1}{2}\right)^2 \pi, \quad (1)$$

an effective screw cross-sectional area S2 of the second rotation shaft portion in the screw conveyor section being represented by the following expression (2), $$S2 = \left(\frac{R}{2}\right)^2 \pi - \left(\frac{r2}{2}\right)^2 \pi, \text{ and} \quad (2)$$

S1, S2, P1 and P2 satisfying the following expression (3), $$P1 \times S1 = P2 \times S2 \quad (3),$$

wherein R denotes an outer diameter of the screw conveyor section, r1 denotes a shaft diameter of the first rotation shaft portion, r2 denotes a shaft diameter of the second rotation shaft portion, P1 denotes the pitch of the first blade portion and P2 denotes the pitch of the second blade portion.

2. The toner cartridge of claim 1, wherein the screw conveyer section comprises a transmission section for transmitting a driving force that rotates the rotation shaft, and the transmission section is connected to the first rotation shaft portion.

3. An image forming apparatus comprising:

a photoreceptor on which an electrostatic latent image is to be formed;

a developing section for feeding a toner to the photoreceptor and developing the electrostatic latent image; and a toner replenishing section for replenishing a toner to the developing section, the toner replenishing section comprising the toner cartridge of claim 1.

4. The image forming apparatus of claim 3, further comprising a guide section for leading a toner discharged from the toner discharge part of the toner cartridge to the developing section, wherein the guide section includes a communicating guide part having a communicating space which is a communicating space opened at both sides in a vertical direction, through which communicating space the toner passes toward the developing section from the toner discharge part.

5. An image forming method comprising forming an image using the image forming apparatus of claim 3.

* * * * *